US007270570B1

(12) United States Patent
Hamner et al.

(10) Patent No.: US 7,270,570 B1
(45) Date of Patent: Sep. 18, 2007

(54) STACKED CONNECTOR ASSEMBLY

(75) Inventors: Richard Elof Hamner, Hummelstown, PA (US); Michael Warren Fogg, Harrisburg, PA (US); Eric Leonard Himelright, Harrisburg, PA (US); Justin Shane McClellan, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/513,586

(22) Filed: Aug. 31, 2006

(51) Int. Cl.
*H01R 13/648* (2006.01)

(52) U.S. Cl. ..... 439/607; 439/541.5; 439/680

(58) Field of Classification Search ..... 439/541.5, 439/607, 680

See application file for complete search history.

(56) References Cited

U.S. PATENT DOCUMENTS

| | | | | |
|---|---|---|---|---|
| 6,099,351 | A * | 8/2000 | Wu | 439/607 |
| 6,162,089 | A | 12/2000 | Costello et al. | |
| 6,183,270 | B1 * | 2/2001 | Huang et al. | 439/79 |
| 6,350,134 | B1 | 2/2002 | Fogg et al. | |
| 6,827,605 | B2 | 12/2004 | Wu | |
| 6,986,681 | B2 * | 1/2006 | Tsai | 439/607 |

* cited by examiner

*Primary Examiner*—Tho D. Ta

(57) ABSTRACT

A stacked electrical connector includes a dielectric housing having an upper face opposite a mounting face and opposed sides between the upper face and the mounting face. The housing holds one row of contacts in a lower contact area between lower side sections of the housing. Two rows of contacts are held in an upper contact area. The housing includes an unshielded spacing section separating the upper and lower contact areas. A lower shield includes a shroud surrounding the lower contact area and side panels that cover the lower side sections of the housing. An upper shield includes a shroud that surrounds the upper contact area.

18 Claims, 10 Drawing Sheets

STACKED CONNECTOR ASSEMBLY

BACKGROUND OF THE INVENTION

The invention relates generally to electrical connectors and, more particularly, to a stacked connector assembly mounted on a circuit board.

There is an increasing demand for digital content in today's society in both the home and the workplace. Hi-Definition Multimedia Interface (HDMI) is a transmission interface developed for multimedia audio video systems including DVD players, game box converters, TV set top boxes, and the like. With the capability for transmitting digital signals, HDMI technology avoids signal losses associated with digital to analog conversions. Liquid crystal displays have become an output device of choice in audio visual products and personal computer displays. Demand for such products has increased the need for HDMI connectors capable of transmitting digital signals to the output devices.

The proliferation of digitally formatted data such as in digital music files and digital photographs in addition to email and other household or business data has led to an ongoing need for disk space or more generally, storage space in personal computers. Disk drives are now being designed to comply with a newer standard, generally referred to as the Serial Advanced Technology Attachment (SATA) standard, which is the standard presently favored for newer computers. External SATA or eSATA brings the benefits of SATA to external data storage. ESATA provides a more robust and user friendly connection that is faster than previous external storage solutions.

Some devices, such as set top boxes, game box converters, etc. may contain both HDMI and eSATA ports. Both HDMI connectors and eSATA connectors are typically mounted at the edge of circuit boards to facilitate access of cable mounted external connectors to the internal circuits of the host devices. Typically, component area on the circuit boards is limited. As a result, it is desirable to conserve space on the circuit boards. With the ongoing development of new technologies such as HDMI and eSATA, conserving component area on the circuit boards is challenging.

BRIEF DESCRIPTION OF THE INVENTION

According to an exemplary embodiment of the invention, a stacked electrical connector is provided. The connector includes a dielectric housing having an upper face opposite a mounting face and opposed sides between the upper face and the mounting face. The housing holds one row of contacts in a lower contact area between lower side sections of the housing. Two rows of contacts are held in an upper contact area. The housing includes an unshielded spacing section separating the upper and lower contact areas. A lower shield includes a shroud surrounding the lower contact area and side panels that cover the lower side sections of the housing. An upper shield includes a shroud that surrounds the upper contact area.

Optionally, the lower contact area includes a lower rear wall from which the first row of contacts extend, and the upper contact area includes an upper rear wall from which the second and third rows of contacts extend. The spacing section separates the upper and lower rear walls. The lower contact area includes a lower rear wall from which the first row of contacts extend. The upper contact area includes an upper rear wall from which the second and third rows of contacts extend. The opposed sides of the housing define a cavity rearward of the upper and lower rear walls. The lower contact area defines a lower connector and the upper contact area defines an upper connector. The lower connector and the upper connector have mating faces that are substantially coplanar with one another. The lower connector is eSATA compliant and the upper connector is HDMI compliant.

DETAILED DESCRIPTION OF THE INVENTION

Figure 1:
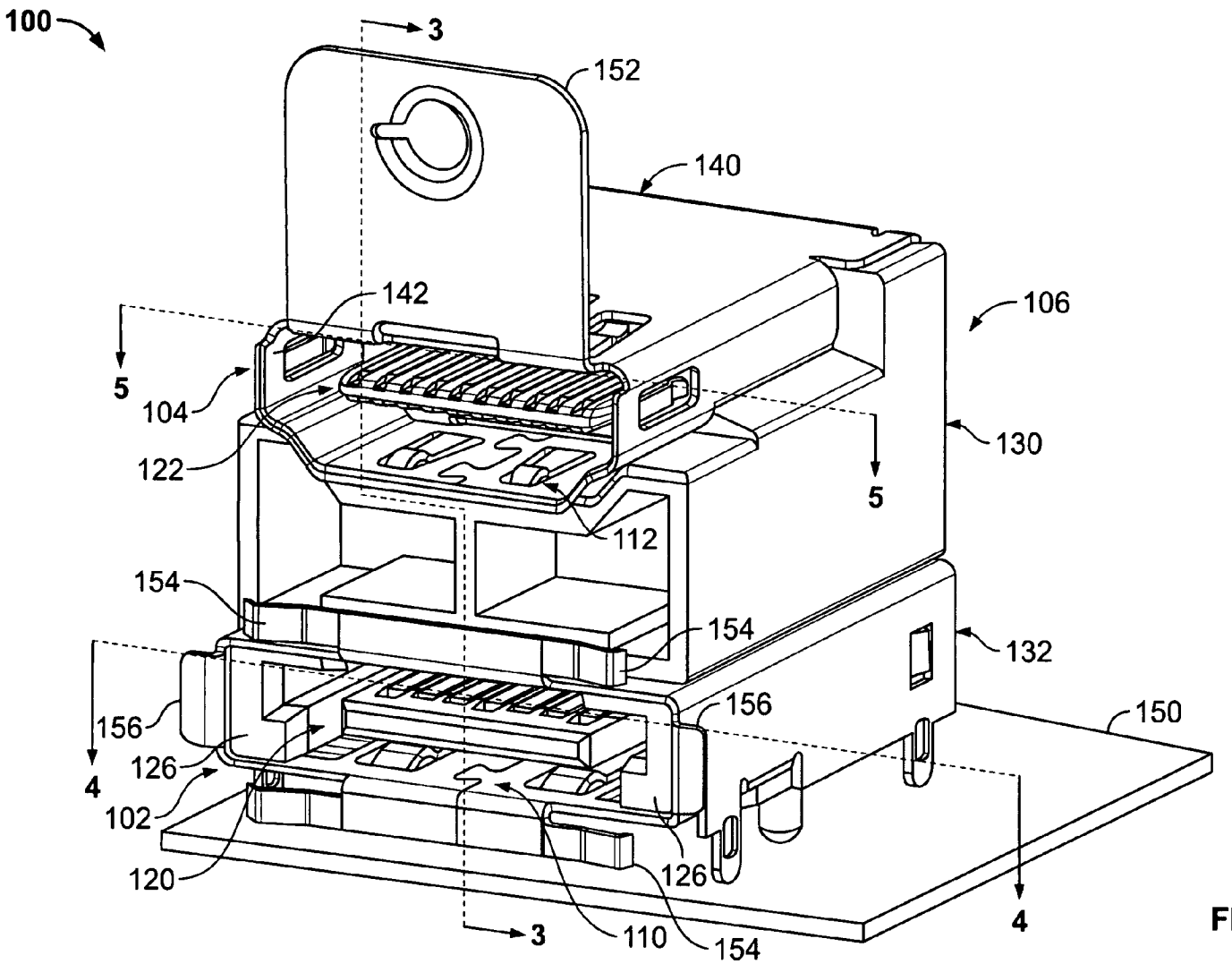
FIG. 1 is a perspective view of a stacked connector assembly formed in accordance with an exemplary embodiment of the present invention.

FIG. 1 illustrates a stacked connector assembly 100 formed according to an exemplary embodiment of the present invention. The connector assembly 100 includes a first or lower connector 102 and a second or upper connector 104. The upper connector 104 is stacked above the lower connector 102. The connectors 102 and 104 have a common housing 106 and mating faces 110 and 112, respectively, that are substantially coplanar. The housing 106 includes a lower contact area 120 and a second or upper contact area 122. A lower shield 132 includes a shroud 134 (FIG. 2) that surrounds the lower contact area 120. An upper shield 140 includes a shroud 142 that surrounds the upper contact area 122. The lower contact area 120 and shroud 134 define the lower connector 102 and the upper contact area 122 and upper shroud 142 define the upper connector 104. In an exemplary embodiment, the lower connector 102 may comprise an eSATA connector and the upper connector 104 may comprise an HDMI connector. It is to be understood, however, that these implementations are set forth by way of example only, and that other applications of the inventive concepts herein are also contemplated.

The connector assembly 100 is configured to be mounted on a circuit board 150. In one application, the assembly 100 may be used in a device such as a set top box (not shown), and in such applications, the upper shield 140 is provided with a mounting tab 152 to mount the assembly 100 to a panel on the box. When attached to the box, fingers 154 and tabs 156 on the lower shield 132 are brought into engagement with the box panel to establish grounding connections.

Figure 2:
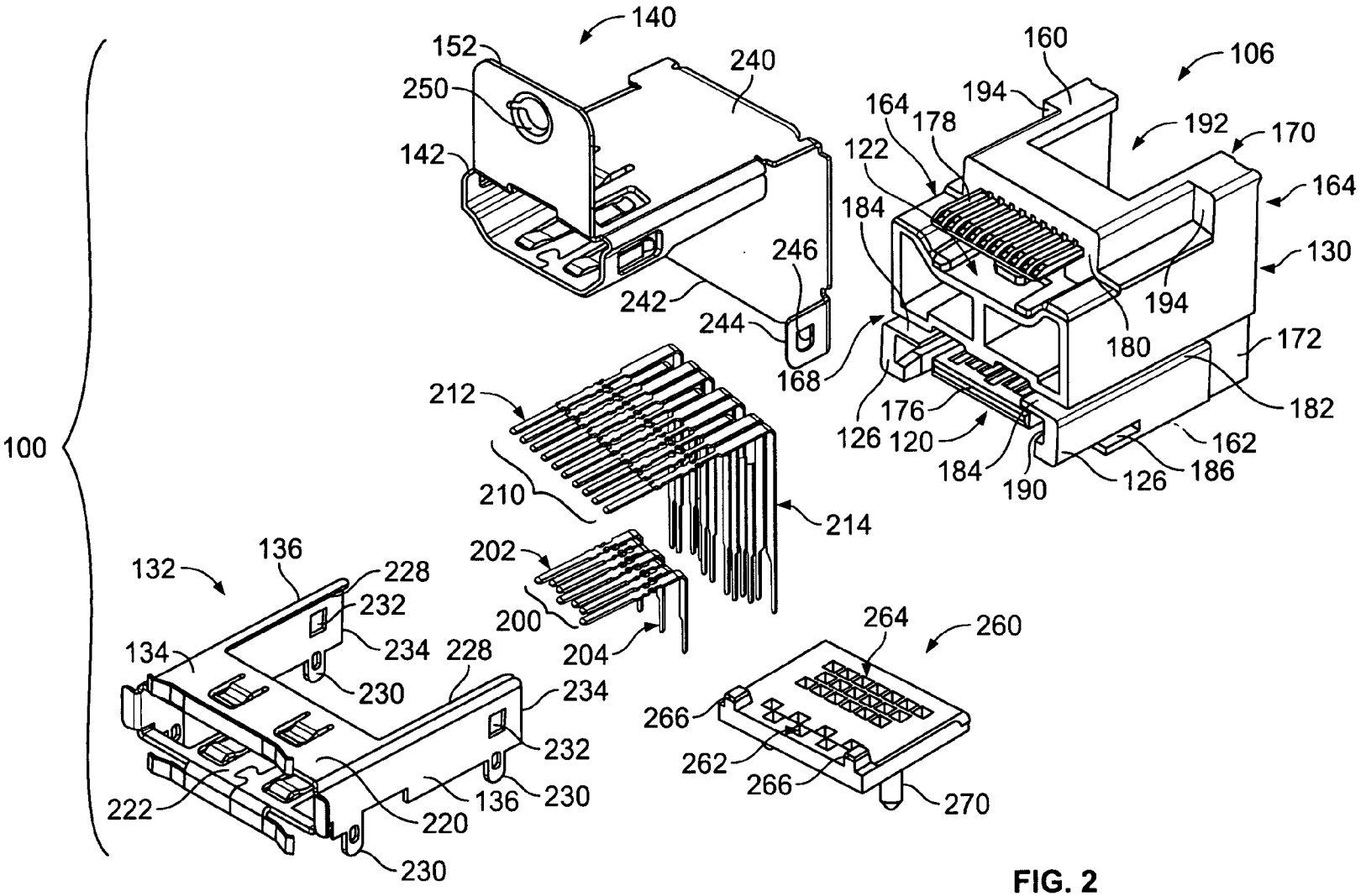
FIG. 2 is an exploded view of the connector assembly shown in FIG. 1.

FIG. 2 illustrates an exploded view of the connector assembly 100. The housing 106 is used as a carrier for the remaining components of the connector assembly 100. The housing 106 is fabricated from a dielectric material and includes an upper face 160 that is opposite a mounting face 162. Opposed sides 164 extend between the upper face 160 and the mounting face 162. The opposed sides 164 include the lower side sections 126. A spacing section 130 separates the lower contact area 120 and the upper contact area 122. The housing 106 has a front face 168 and a rearward end 170 opposite the front face 168. The lower side sections 126 include a recess 172 at a rearward end thereof. A lower tongue 176 is positioned in the lower contact area 120, and an upper tongue 178 is positioned in the upper contact area 122. The upper tongue 178 extends from a rear wall 180. The lower tongue 176 also extends from a lower rear wall (not shown in FIG. 2). A groove 182 extends along the sides 164 proximate the lower side sections 126, and a channel 184 is formed in the front face 168 of the housing 106. A lower channel 186 is formed proximate the mounting face 162. The lower side sections 126 of the housing sides 164 include rearwardly extending channels 190. A cavity 192 is formed between rearward portions of the sides 164 of the housing 106. Shoulders 194 are formed in the housing 106 proximate the upper face 160.

A first group of contacts 200 is held in the lower contact area 120 of the housing 106. Each of the contacts 200 includes a mating end 202 and a contact tail 204. The contacts 200 are arranged in a single row across the tongue 176. A second group of contacts 210 are held in the upper contact area 122 of the housing 106. The contacts 210 are arranged in two rows, one on each side of the tongue 178 as will be described. Each of the contacts 210 includes a mating end 212 and a contact tail 214.

The lower shield 132 includes a shroud 134 and side panels 136 that extend rearwardly from the shroud 134. The shroud 134 includes an upper web portion 220 and a lower web portion 222 between the side panels 136. The web portions 220 and 222 are received in the channels 184 and 186 respectively. Each side panel 136 includes a lip 228 that is received in the groove 182 in the sides 164 of the housing 106. Mounting tabs 230 are provided to mount the shield 132 to the circuit board 150 (FIG. 1). In one embodiment, the tabs 230 electrically engage a ground circuit in the circuit board 150. A window 232 is formed at a rearward end 234 of the side panels 136.

The upper shield 140 includes the shroud 142 and a top side 240 that covers the upper surface 160 of the housing 106 when the upper shield 140 is installed on the housing 106. During installation, a rear panel 242 is folded over the rearward end 170 of the housing 106. Tabs 244 are received in the recesses 172 on the housing 106 and electrically engage the side panels 136 on the lower shield 132 to provide a common ground with the lower shield 132. The tabs 244 include latches 246 that engage the windows 234 in the side panels 136 of the lower shield 132. The mounting tab 152 includes an attachment hole 250 formed with a stamped thread for convenient screw attachment to a panel (not shown). In some embodiments, the upper shield 140 and the lower shield 132 may be formed as a single unit.

An organizer 260 is received in a recess (not shown) at the mounting end 162 of the housing 106. The organizer 260 includes a first group of apertures 262 that receive contact tails 204 of the first contact group 200 and a second group of apertures 264 that receive contact tails 214 of the second contact group 210. The organizer 260 has keying posts 266 that key the housing 106 to the organizer 260. Mounting posts 270 are provided to guide and align the organizer 260 to the circuit board 150. The aperture groups 262 and 264 coincide with pin patterns on the circuit board 150. Contact tails 204 and 214 of the contacts of the first and second contact groups 200, 210 extend through the organizer 260 and are electrically connected to the circuit board 150.

Figure 3:
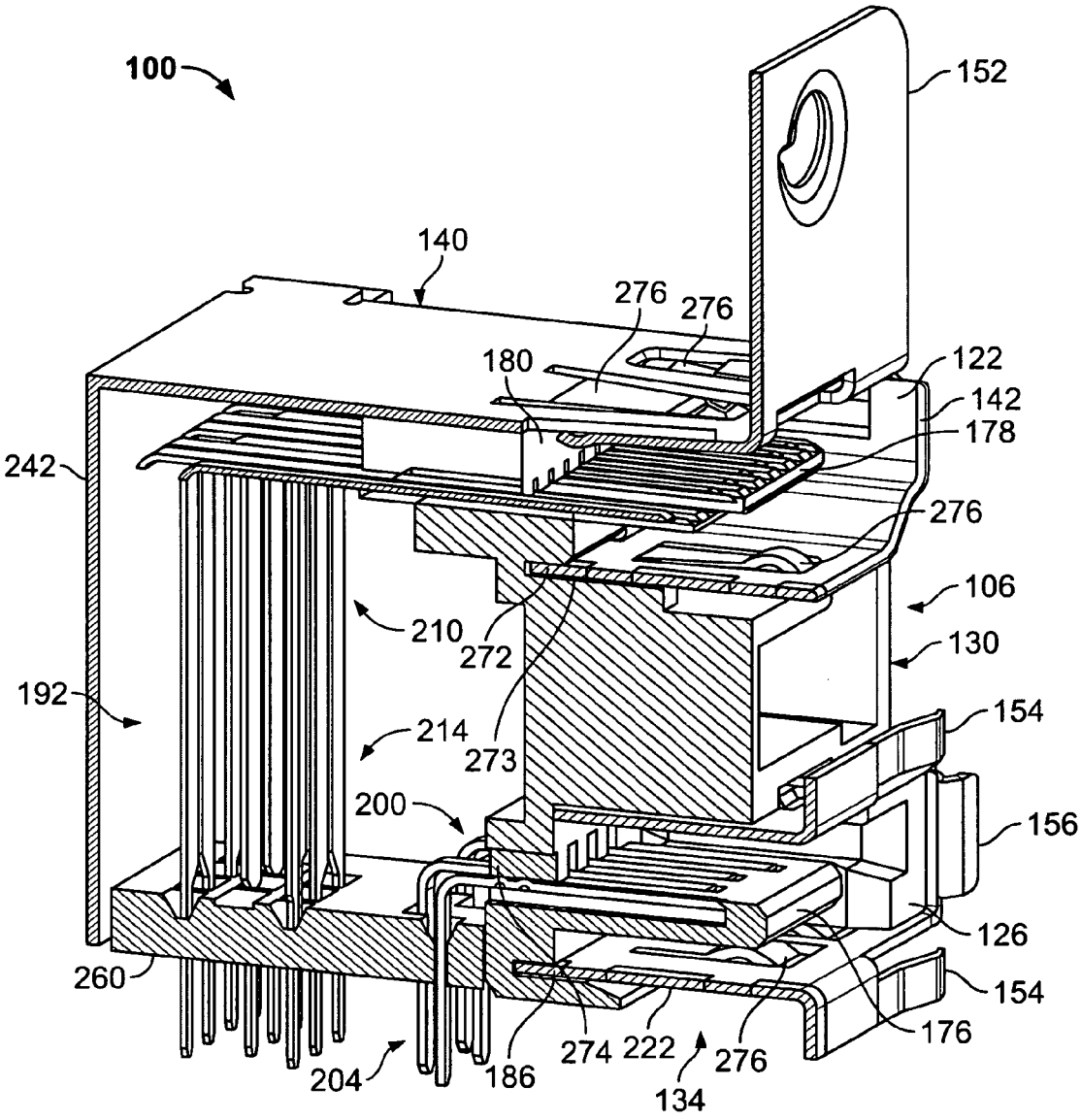
FIG. 3 is a cross-sectional view of the connector assembly shown in FIG. 1 taken along the line 3-3.

FIG. 3 is a cross-sectional view of the connector assembly 100 taken along the line 3-3 in FIG. 1. The housing 106 includes a rearward cavity 192 that is closed at the bottom by the organizer 260 and at the rear by the rear panel 242 of the upper shield 140. The contact tails 204, 214 of the contacts 200 and 210, respectively extend into the cavity 192 where they are bent approximately ninety degrees and arranged so that they can be received into the organizer 260. Because the contacts 210 are held in the second or upper contact area 122, the contact tails 214 are longer and extend further into the cavity 192 than do the contact tails 204. The upper shroud 142 includes a rearward edge 272 that is received in a slot 273 in the housing 106. The rearward edge 272 bottoms in the slot 273 to position the upper shield 140 on the housing 106.

The lower tongue 176 extends from a lower rear wall 274. The lower rear wall 274 also holds the contacts 200. The contact tails 204 extend rearwardly from the lower rear wall 274 and into the organizer 260. The upper tongue 178 extends from the upper rear wall 180. The upper rear wall 180 also holds the contacts 210. The contact tails 214 extend rearwardly from the upper rear wall 180 and into the organizer 260. Each shroud 134 and 142 includes spring fingers 276 that engage and facilitate retaining the mating connectors. The spring fingers 276 also provide grounding and shielding for the mating connectors. The lower web portion 222 of the lower shield 132 (FIG. 2) is received in the channel 186. The depth of the channel 186 controls the positioning of the lower shield 132 on the housing 106. Similarly, the depth of the channels 184 (FIG. 2) and 186 establish the positioning of the lower shield 132 by limiting the rearward travel of the upper web portion 220 (FIG. 2) and lower web portion 222.

Figure 4:
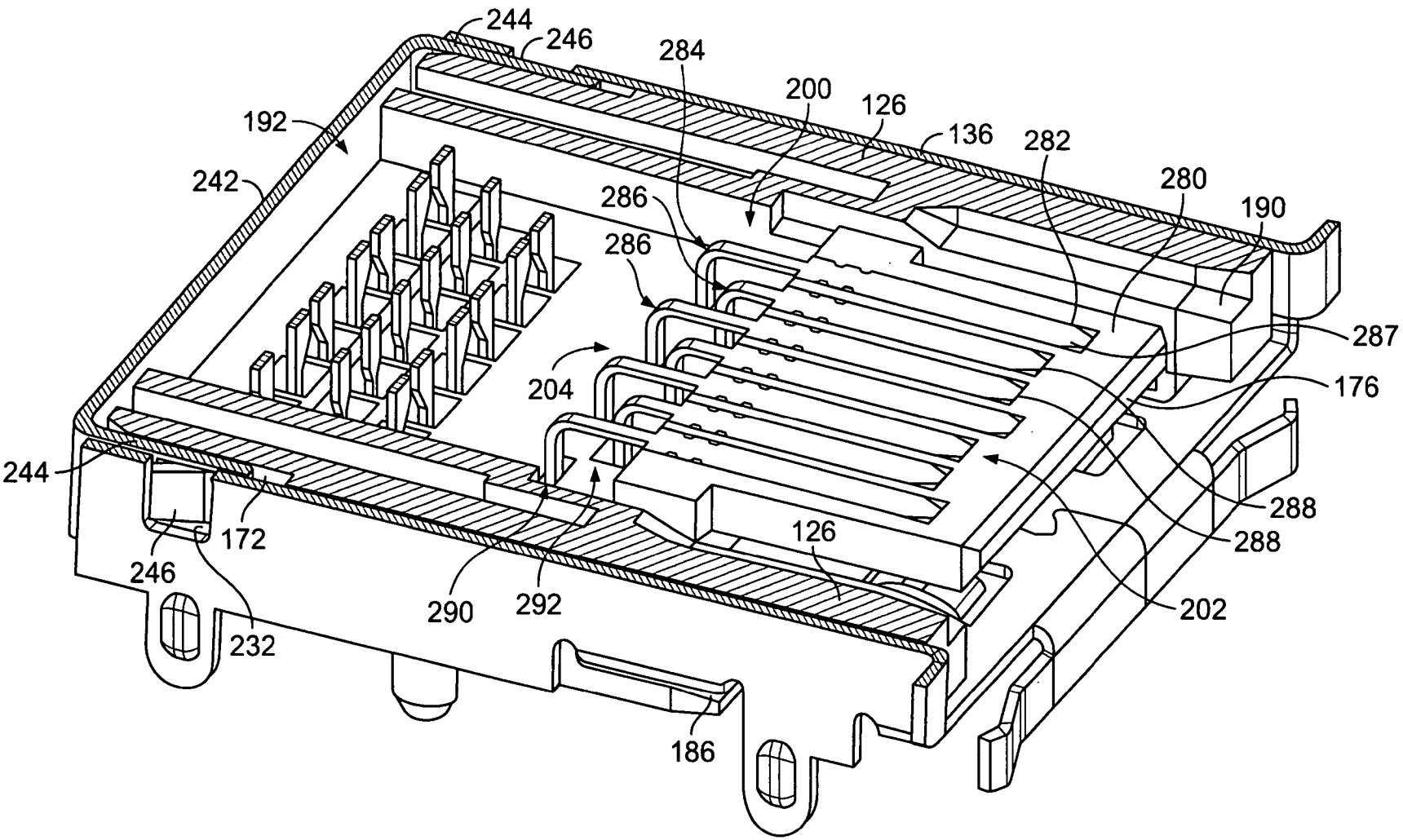
FIG. 4 is a cross-sectional view of the connector assembly shown in FIG. 1 taken along the line 4-4.

FIG. 4 is a cross-sectional view of the connector assembly 100 taken along the line 4-4 in FIG. 1. The mating ends 202 of the contacts 200 are supported on a surface 280 of the lower tongue 176. In one embodiment, the mating ends 202 are received in slots 282 formed in the lower tongue 176 of the housing 106 (FIG. 2). The contacts 200 include ground contacts 284 and signal contacts 286. The ground contact mating ends 287 are slightly longer than the signal contact mating ends 288 as shown. The mating ends 202 of the contacts 200 are arranged in a single row across the tongue 176. Within the row, the contact mating ends 202 are arranged in a pattern wherein pairs of signal contact mating ends 288 are positioned between individual ground contact mating ends 287. In the cavity 192, the contact tails 204 are staggered into two rows 290 and 292 with the contact tails 204 alternating between the two rows 290, 292 such that adjacent contact tails 204 are in different rows. So arranged, it can be seen that the contact tails 204 of each signal contact pair are separated with one in each row. The separation of the contact tails 204 into two rows 290, 292 prevents solder bridging during the wave soldering process while maintaining electrical performance.

As illustrated, the channel 190 extends rearwardly in the lower side section 126 substantially parallel to the tongue 176. In an exemplary embodiment, the channel 190 receives a rail formed on a mating connector (not shown). The tabs 244 of the upper shield 140 (FIG. 2) are received in the recess 172 beneath the side panel 136 of the lower shield 132

(FIG. 2). The latch 246 on the tab 244 of the upper shield 140 engages an edge of the window 232 of the lower shield 132. In this manner, a common ground is established between the upper and lower shields 140 and 132 respectively.

Figure 5:
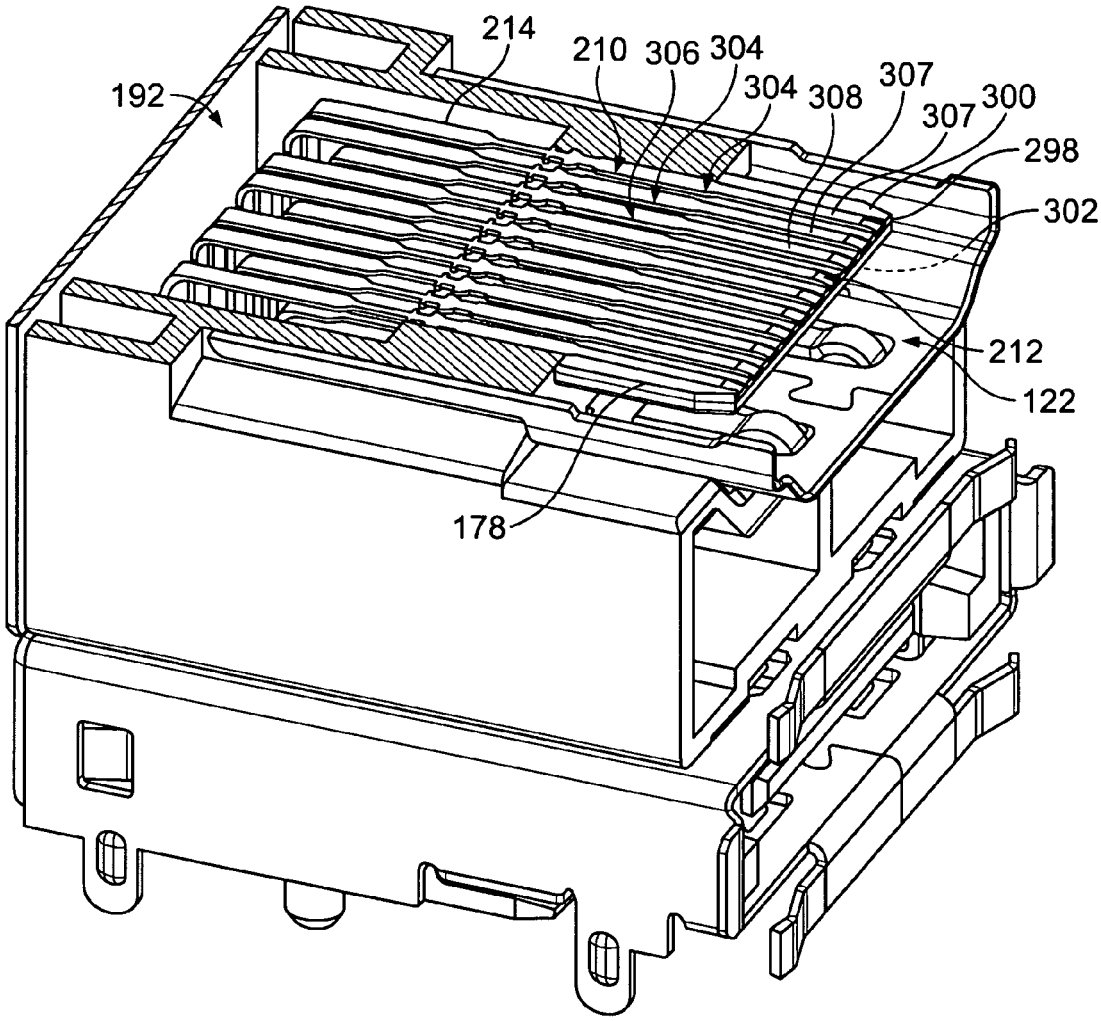
FIG. 5 is a cross-sectional view of the connector assembly shown in FIG. 1 taken along the line 5-5.

FIG. 5 is a cross-sectional view of the connector assembly 100 taken along the line 5-5 in FIG. 1. The upper contact area 122 includes contacts 210, the mating ends 212 of which are distributed in two rows with one row in slots 298 on the upper surface 300 of the tongue 178 and a second row in slots (not shown) on a lower surface 302 of the tongue 178. In an exemplary embodiment, the contacts 210 comprise a total of nineteen individual contacts with ten contacts placed on the upper surface 300 of the tongue 178 and nine contacts placed on the lower surface 302 of the tongue 178. The contacts 210 include signal contacts 304 and ground contacts 306. The mating ends 212 of the contacts 210 are arranged in a row on both sides 300 and 302 of the tongue 176. Within each row, the contact mating ends 212 are arranged in a pattern wherein pairs of signal contact mating ends 307 are positioned between individual ground contact mating ends 308.

Figure 6:
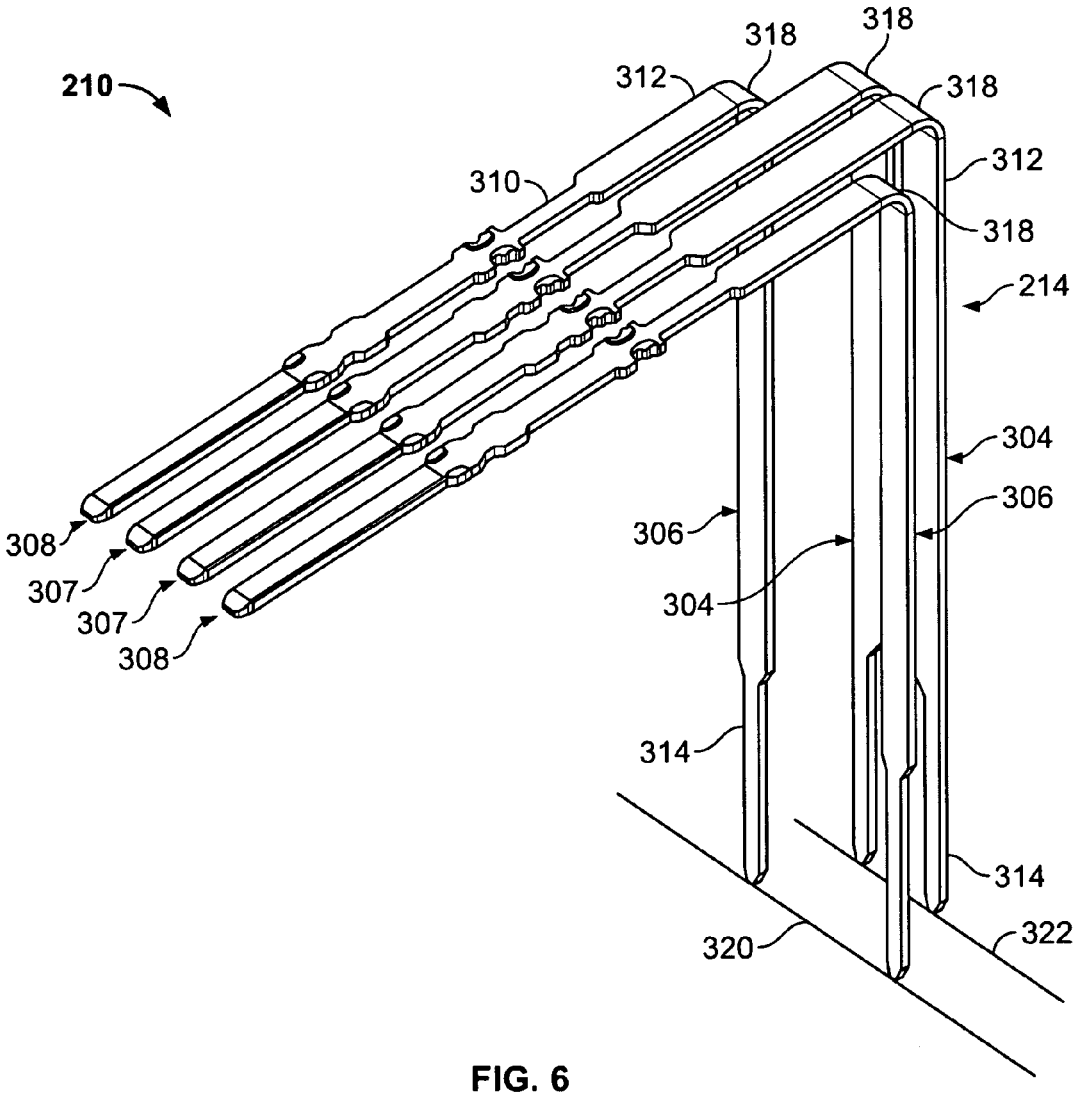
FIG. 6 is an enlarged perspective view of a group of contacts on the upper surface of the tongue of the upper connector.

The contact tails 214 of the upper contacts 210 are longer than the contact tails 204 of the lower contacts 200 (FIG. 2) and are designed with a varied width and a different contact pattern that improves performance and minimizes crosstalk. With reference to FIG. 6, the contact tails 214 have a necked down section 310 and a widened section 312 extending to the solder tail 314. The contact tails 214 are arranged in a three row contact pattern in the cavity 192 as will be described.

FIG. 6 illustrates an enlarged perspective view of a group of contacts 210 from the upper surface 300 of the tongue 178 (FIG. 5). The contacts 210 are arranged in a pattern having a pair of signal contacts 304 between individual ground contacts 306. The contacts 210 are formed with necked down sections 310 followed by widened sections 312. As illustrated, the signal contacts 304 are longer than the ground contacts 306 before the ninety degree bends 318 such that the solder tails 314 of the ground contacts 306 lie in a row 320 in front of a signal contact row 322.

Figure 7:
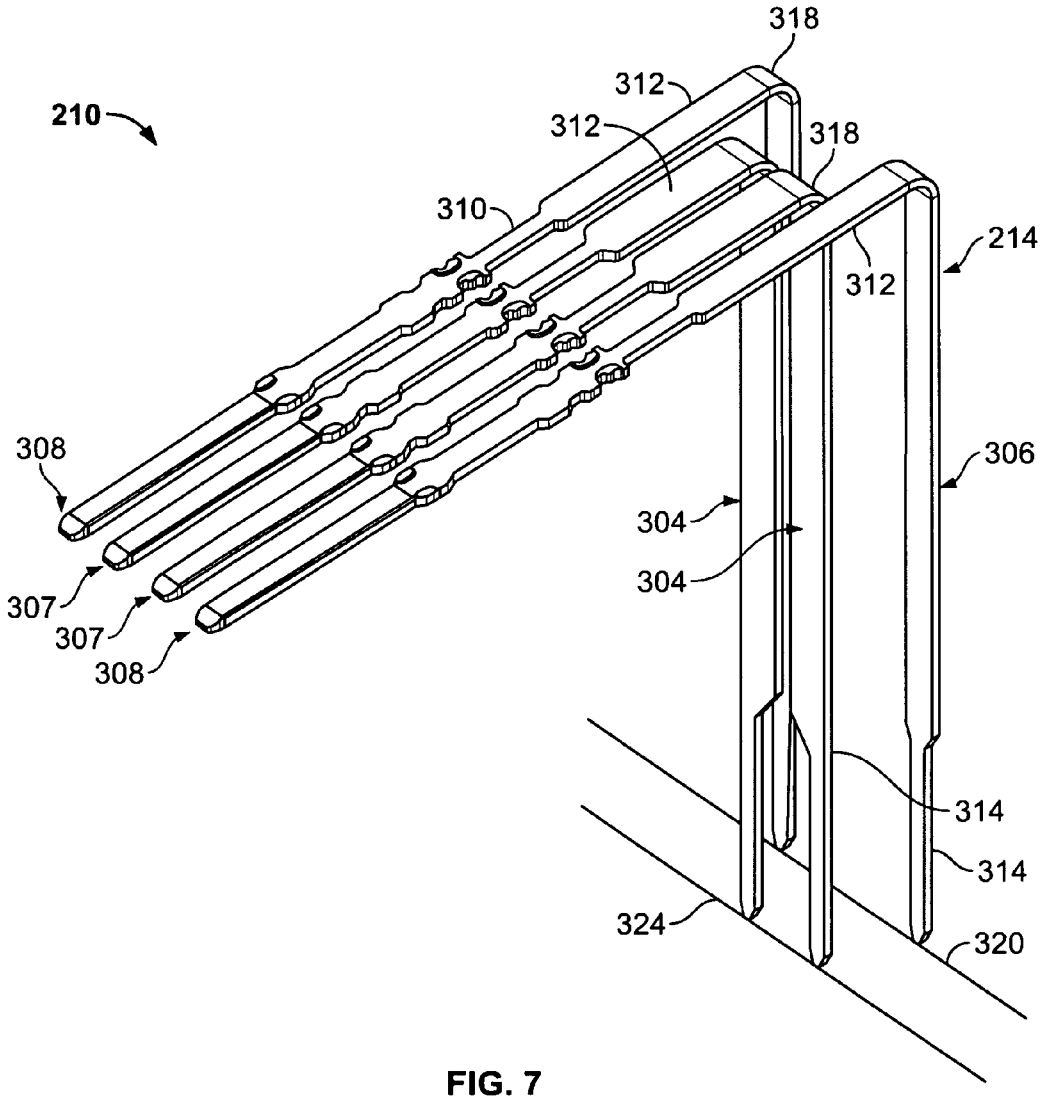
FIG. 7 is an enlarged perspective view of a group of contacts on the lower surface of the tongue of the upper connector.

FIG. 7 illustrates an enlarged perspective view of a group of contacts 210 from the lower surface 302 of the tongue 178 (FIG. 5). The contacts 210 are arranged in a pattern having a pair of signal contacts 304 between individual ground contacts 306. The contacts 210 are formed with necked down sections 310 followed by widened sections 312. In contrast to the contacts 210 on the upper surface 300 of the tongue 178 shown in FIG. 6, the ground contacts 306 are longer than the signal contacts 304 before the ninety degree bends 318 such that the solder tails 314 of the signal contacts 304 lie in a row 324 in front of the ground contact row 320.

Figure 8:
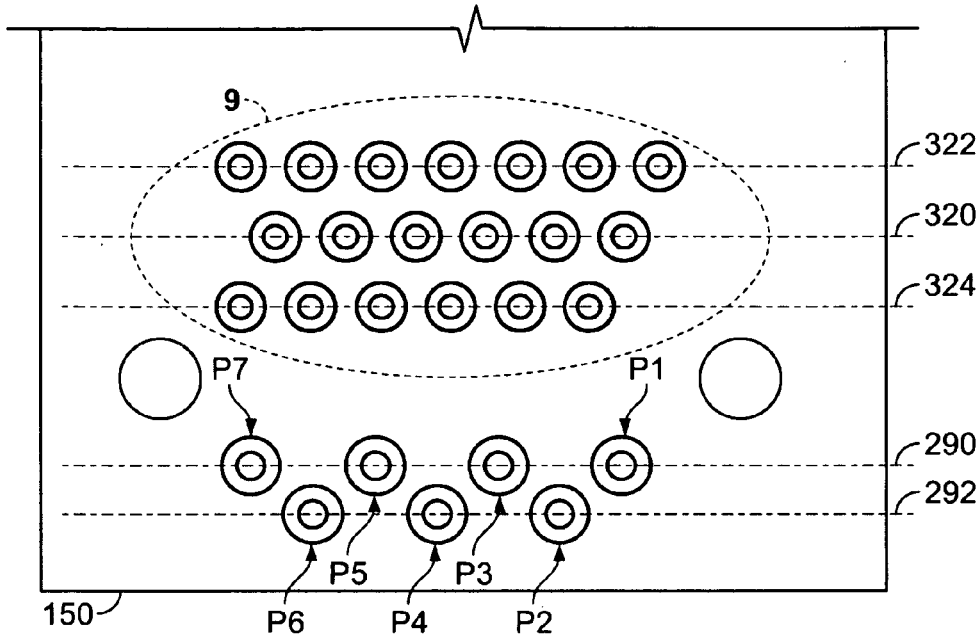
FIG. 8 is a top view of the pin layout for the stacked connector shown in FIG. 1.

FIG. 8 illustrates a top view of the pin layout for the connector assembly 100 (FIG. 1). Pin rows, or contact rows 290 and 292 represent the pin positions of the lower connector 102 (FIG. 1) which, in an exemplary embodiment, may be an eSATA connector. The ground-signal-signal-ground pattern of the contact mating ends 202 (FIG. 2) on the lower tongue 176 as shown in FIG. 4 is repeated in a zigzag manner on the circuit board 150. That is pin position P1 is a ground pin position while positions P2 and P3 are signal pin positions.

Pin rows, or contact rows 320, 322, and 324 represent the pin positions of the upper connector 104 (FIG. 1) which, in an exemplary embodiment, may be an HDMI connector. As illustrated ground pin row 320 is positioned between signal pin rows 322 and 324. The ground pin row 320 is offset such that the ground pin positions are centered between the signal pin positions.

Figure 9:
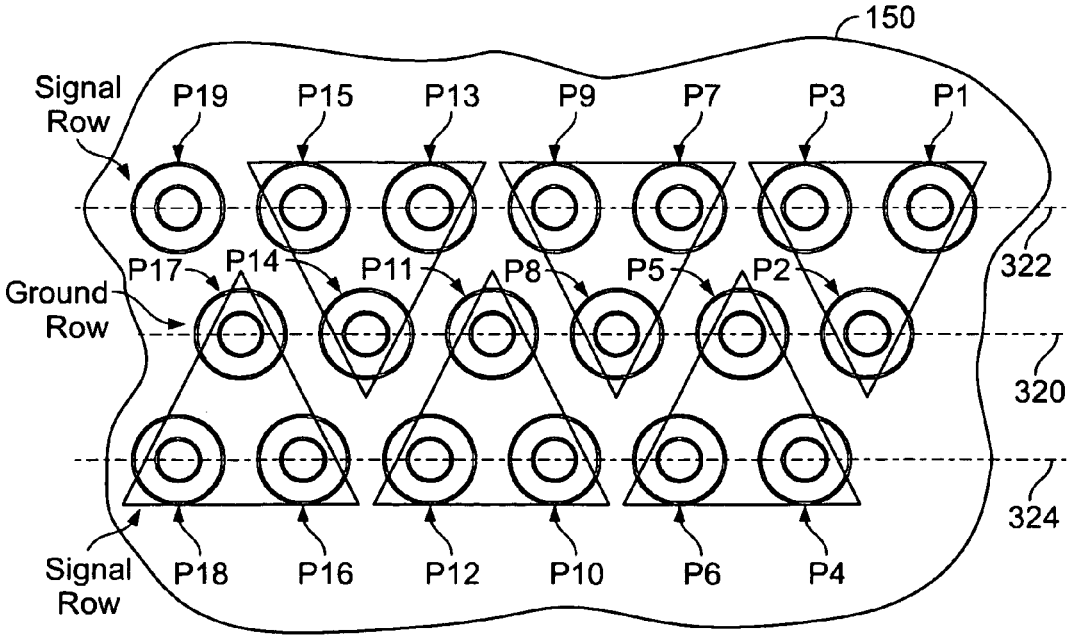
FIG. 9 is a detailed view of the upper connector pin layout shown in FIG. 8.

FIG. 9 illustrates a detailed view of the upper connector pin layout shown in FIG. 8. A pin or contact grouping is illustrated wherein one ground pin is associated with a pair of signal pins in a triangular arrangement. The triangular grouping alternates with similar but inverted triangular patterns across the circuit board 150. The triangular grouping facilitates reducing crosstalk in the upper connector 104.

Figure 10:
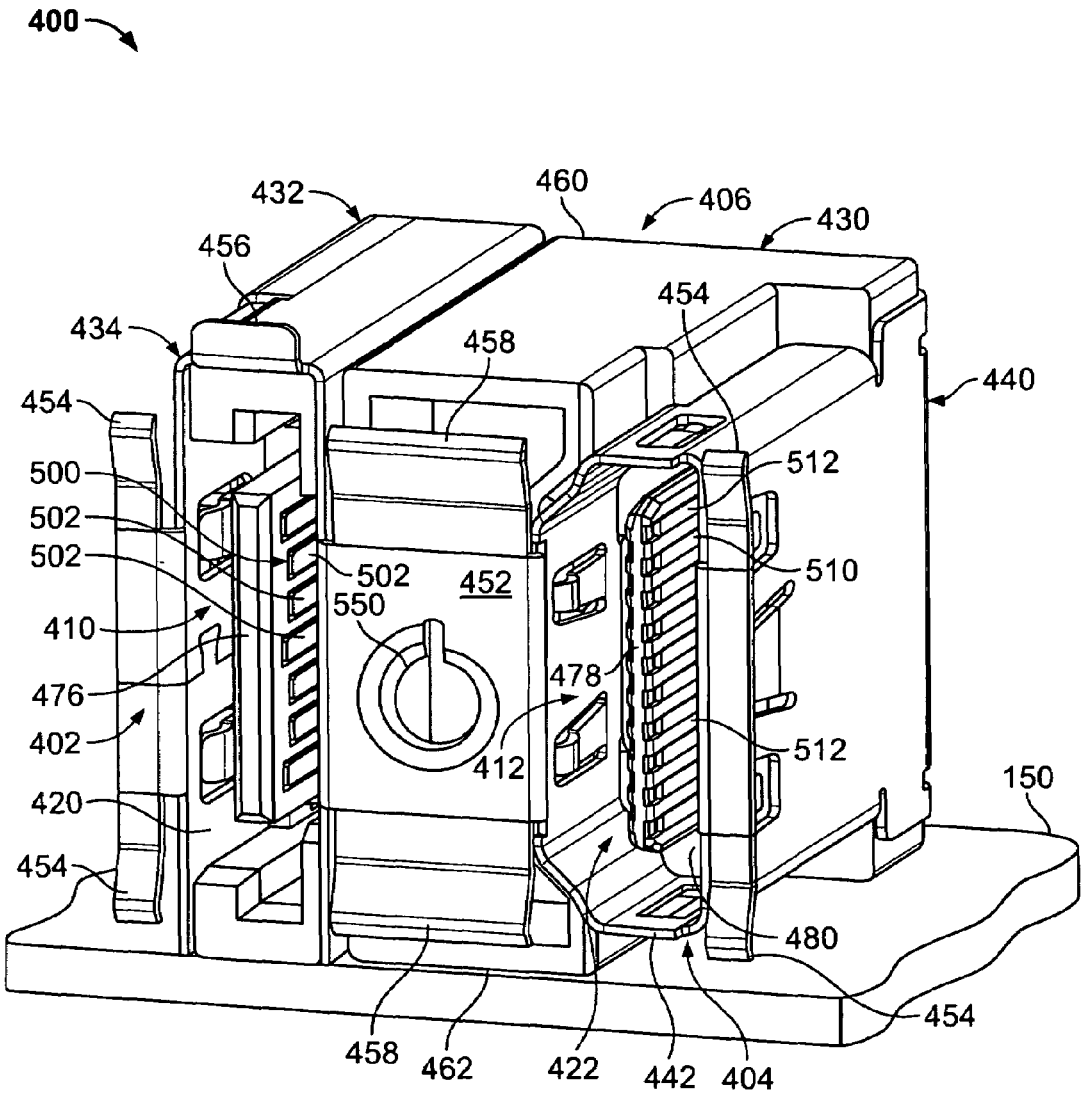
FIG. 10 illustrates a combined connector assembly formed in accordance with an alternative embodiment of the present invention.

FIG. 10 illustrates a combined connector assembly 400 formed in accordance with an alternative embodiment of the present invention. The connector assembly 400 includes a first connector 402 and a second connector 404 positioned adjacent one another. The connector assembly 400 is similar to the connector assembly 100 (FIG. 1) previously described, with the exception of the orientation of the connector assembly 400 with respect to the circuit board 150. The connectors 402 and 404 have a common housing 406 and mating faces 410 and 412, respectively, that are substantially coplanar. The housing 406 includes a first contact area 420 and a second contact area 422. The housing 406 includes a spacing section 430 that separates the first and second contact areas 420 and 422, respectively. A first shield 432 includes a shroud 434 that surrounds the first contact area 420. A second shield 440 includes a shroud 442 that surrounds the second contact area 422. A mounting tab 452 is attached to the first shield 432 and is folded in front of the spacing section 430. The mounting tab 452 includes a mounting hole 550 formed with a stamped thread for attachment to a panel (not shown). Alternatively, the mounting tab 452 may be attached to the second shield 440. The mounting tab 452 also includes spring fingers 458. In some embodiments, the second shield 440 and the first shield 432 may be formed as a single unit. The first contact area 420 and shroud 434 define the first connector 402 and the second contact area 422 and second shroud 442 define the second connector 404. As illustrated, the first connector 402 may comprise an eSATA connector and the second connector 404 may comprise an HDMI connector.

The housing 406 is fabricated from a dielectric material and includes an upper face 460 opposite a mounting face 462. A first tongue 476 is positioned in the first contact area 420, and a second tongue 478 is positioned in the second contact area 422. The second tongue 478 extends from a rear wall 480. The first tongue 476 also extends from a rear wall (not shown). A cavity (not shown) is formed between rearward portions of the upper face 460 and the mounting face 462 of the housing 406 and is similar to the cavity 192 shown in FIG. 3.

A first group of contacts 500 is held in the first contact area 420 of the housing 406. Each of the contacts 500 includes a mating and 502 and a contact tail (not shown). The contacts 500 are arranged in a single row across the tongue 476. A second group of contacts 510 are held in the second contact area 422 of the housing 406. The contacts 510 are arranged in two rows, one on each side of the tongue 478. Each of the contacts 510 includes a mating end 512 and a contact tail (not shown).

Figure 11:
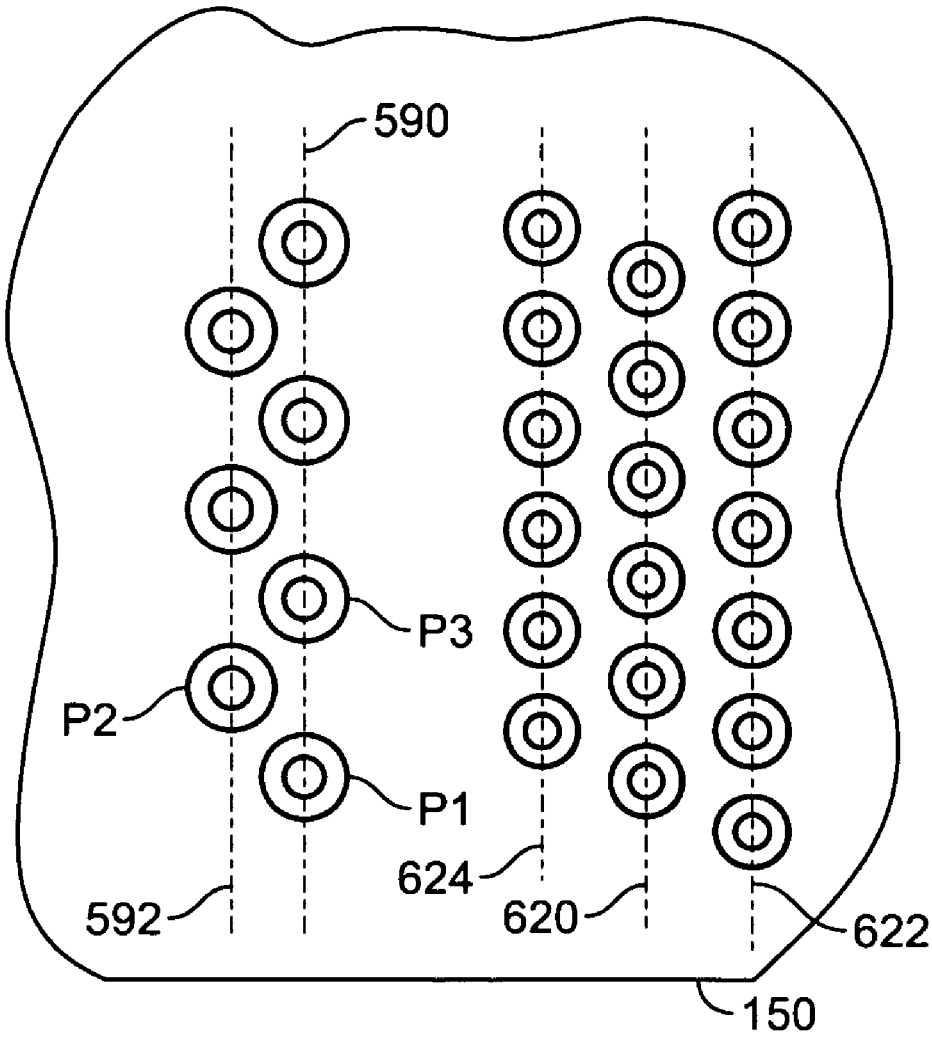
FIG. 11 is a top view of the pin layout for the combined connector shown in FIG. 10.

FIG. 11 illustrates a top view of the pin layouts for the connector assembly 400 shown in FIG. 10. The pin layouts shown in FIG. 11 are similar to the pin layouts shown in FIG. 8 with the exception that the layouts are rotated clockwise ninety degrees. As would be understood by one skilled in the art, the contact tails (not shown) are bent differently from the previously described geometry to conform to the pin layouts presently illustrated. Pin rows, or contact rows 590 and 592 represent the pin positions of the first connector 402 (FIG. 10). The ground-signal-signal-ground pattern of the contact tails is preserved in a zigzag manner on the circuit board 150 with pin position P1 being a ground pin position and positions P2 and P3 being signal pin positions.

Pin rows, or contact rows 620, 622, and 624 represent the pin positions of the second connector 404 (FIG. 10). Pin row 620 is a ground pin row and is positioned between signal pin rows 622 and 624. The ground pin row 620 is offset such that the ground pin positions are centered between the signal pin positions in pin rows 622 and 624 as detailed in the previously described embodiment.

With reference to FIG. 10, the connector assembly 400 is configured to be mounted on the circuit board 150 and installed in set top box type devices. When installed in such a device, fingers 454 and 458 and tabs 456 on the first and second shields 432 and 440 are brought into engagement with the box panel to establish grounding connections.

The embodiments herein described provide an eSATA connector and an HDMI in a stacked arrangement in a common housing that saves space on a circuit board. The stacked connector is particularly useful for such devices as set top boxes having limited circuit board space. The mating ends of the connectors are designed to eSATA and HDMI specifications. The longer contact tails of the HDMI connector are designed to maintain impedance and improve signal throughput and noise performance. The HDMI shield includes a tab having a mounting hole with a stamped thread that facilitates simple screw attachment to a panel on the set top box.

While the invention has been described in terms of various specific embodiments, those skilled in the art will recognize that the invention can be practiced with modification within the spirit and scope of the claims.

What is claimed is:

1. A stacked electrical connector comprising:

a dielectric housing having an upper face opposite a mounting face and opposed sides between said upper face and said mounting face, said housing holding one row of contacts in a lower contact area between lower side sections of said housing, and two rows of contacts in an upper contact area, said housing including an unshielded spacing section separating the upper and lower contact areas;

a lower shield including a shroud surrounding said lower contact area and side panels covering said lower side sections of said housing;

an upper shield including a shroud surrounding said upper contact area; and an organizer located at said mounting end of said housing, said organizer including mounting posts for aligning said organizer to a circuit board and keying posts to key said housing to said organizer, said organizer receiving contact tails of said one row and two rows of contacts and positioning said contact tails for attachment to the circuit board.

2. The connector of claim 1, wherein said lower contact area defines a lower connector and said upper contact area defines an upper connector.

3. The connector of claim 1, wherein said lower contact area defines a lower connector having a mating face and said upper contact area defines an upper connector having a mating face and said mating face of said lower connector is substantially coplanar with said mating face of said upper connector.

4. The connector of claim 1, wherein said lower contact area defines a lower connector and said upper contact area defines an upper connector, said lower connector being eSATA compliant and said upper connector being HDMI compliant.

5. The connector of claim 1, wherein each of said one row of contacts and said two rows of contacts includes signal contacts and ground contacts having mating ends, said mating ends being arranged in a pattern wherein pairs of signal contact mating ends and individual ground contact mating ends are arranged in an alternating sequence.

6. The connector of claim 1, wherein said upper shield includes a rear panel folded to engage said lower shield to provide a common ground for said upper and lower shields.

7. The connector of claim 1, wherein said upper shield includes a tab having an aperture configured to receive a fastener to attach said connector to a panel.

8. The connector of claim 1, wherein said housing includes channels that receive web portions of said lower shield and a groove that receives a lip on side panels of said lower shield.

9. The connector of claim 1 wherein said housing includes a slot configured to receive a rearward edge of said upper shield to position said upper shield on said housing.

10. The connector of claim 1, wherein said housing includes a tongue in said lower contact area and said contacts in said one contact row are supported on said tongue.

11. The connector of claim 1, wherein said housing includes a tongue in said upper contact area and said two contact rows are distributed on respective upper and lower surfaces of said tongue.

12. The connector of claim 1, wherein said two contact rows include contacts with contact tails, each having a necked down section followed by a widened section extending to a solder tail.

13. The connector of claim 1, wherein said two contact rows include signal and ground contacts arranged such that contact tails of said ground contact tails are in a single row between two rows of signal contact tails of said signal contacts.

14. The connector of claim 1 wherein said upper shield includes a rear panel folded to engage said lower shield to provide a common ground for said upper and lower shields, said rear panel including a tab having a latch configured to engage an edge of a window in said lower shield.

15. The connector of claim 1, wherein said lower contact area includes a lower rear wall from which said row of contacts extend, and said upper contact area includes an upper rear wall from which said two rows of contacts extend, and wherein said spacing section separates said upper and lower rear walls.

16. The connector of claim 15, wherein said opposed sides of said housing define a cavity rearward of said upper and lower rear walls.

17. A stacked electrical connector comprising:

a dielectric housing having an upper face opposite a mounting face and opposed sides between said upper face and said mounting face, said housing holding one row of contacts in a lower contact area between lower side sections of said housing, and two rows of contacts in an upper contact area said housing including an unshielded spacing section separating the upper and lower contact areas;

a lower shield including a shroud surrounding said lower contact area and side panels covering said lower side sections of said housing; and an upper shield including a shroud surrounding said upper contact area, and wherein said one contact row includes signal contacts and ground contacts, each having a contact tail, and wherein said contact tails are arranged in a mounting pattern comprising a first row and a second row, wherein said contact tails of pairs of said signal contacts are staggered with one signal contact tail being in the first row and the other contact tail being in the second row.

18. A stacked electrical connector comprising:

a dielectric housing having an upper face opposite a mounting face and opposed sides between said upper face and said mounting face, said housing holding one row of contacts in a lower contact area between lower side sections of said housing, and two rows of contacts in an upper contact area, said housing including an unshielded spacing section separating the upper and lower contact areas;

a lower shield including a shroud surrounding said lower contact area and side panels covering said lower side sections of said housing; and an upper shield including a shroud surrounding said upper contact area; and wherein said two contact rows include signal and ground contacts and contact tails of said signal and ground contacts are arranged such that single ground contact tails are associated with pairs of signal contact tails in a triangular pattern with said triangular pattern alternated with inverted triangular patterns across the circuit board.

* * * * *